US005133943A

United States Patent [19]

Abdulally

[11] Patent Number: 5,133,943

[45] Date of Patent: Jul. 28, 1992

[54] FLUIDIZED BED COMBUSTION SYSTEM AND METHOD HAVING A MULTICOMPARTMENT EXTERNAL RECYCLE HEAT EXCHANGER

[75] Inventor: Igbal F. Abdulally, Randolph, N.J.

[73] Assignee: Foster Wheeler Energy Corporation, Clinton, N.J.

[21] Appl. No.: 500,619

[22] Filed: Mar. 28, 1990

[51] Int. Cl.[5] ..... F27B 15/08; F27B 15/09; F27B 15/14; F27B 15/18

[52] U.S. Cl. ..... 422/145; 110/216; 110/245; 122/4 D; 165/104.16; 422/146; 422/147; 431/7; 431/170

[58] Field of Search ..... 422/141, 142, 145, 146, 422/147; 165/104.16; 122/4 D; 110/245, 216; 431/7, 170

[56] References Cited

U.S. PATENT DOCUMENTS

| | | | |
|---|---|---|---|
| 3,893,426 | 7/1975 | Bryers | 122/4 D |
| 4,017,422 | 4/1977 | Gappa et al. | 422/142 X |
| 4,111,158 | 9/1978 | Reh et al. | 122/4 D |
| 4,165,717 | 8/1979 | Reh et al. | 122/4 D |
| 4,227,488 | 10/1980 | Stewart et al. | 122/4 D |
| 4,338,283 | 7/1982 | Sakamoto et al. | 422/112 |
| 4,399,106 | 8/1983 | Ueda | 422/140 |
| 4,469,050 | 9/1984 | Korenberg | 122/4 D |
| 4,594,967 | 6/1986 | Wolowodiuk | 122/4 D |
| 4,617,877 | 10/1986 | Gamble | 122/4 D |
| 4,665,864 | 5/1987 | Seshamani et al. | 122/4 D |
| 4,682,567 | 7/1987 | Garcia-Mallol et al. | 122/4 D |
| 4,686,939 | 8/1987 | Stromberg | 122/4 D |
| 4,694,758 | 9/1987 | Gorzegno et al. | 122/4 D |
| 4,704,084 | 11/1987 | Liu et al. | 431/7 |
| 4,709,662 | 12/1987 | Rawdon | 122/4 D |
| 4,716,856 | 1/1988 | Beisswenger et al. | 122/4 D |
| 4,761,131 | 8/1988 | Abdulally | 431/7 |
| 4,813,479 | 3/1989 | Wahlgren | 165/104.16 |
| 4,856,460 | 8/1989 | Wied et al. | 122/4 D |
| 4,896,717 | 1/1990 | Campbell, Jr. et al. | 165/104.18 |
| 4,947,804 | 8/1990 | Abdulally | 122/4 D |
| 4,969,930 | 11/1990 | Arpalahti | 48/197 R |

*Primary Examiner*—Robert J. Warden
*Assistant Examiner*—Amalia L. Santiago
*Attorney, Agent, or Firm*—Marvin A. Naigur

[57] ABSTRACT

A fluidized bed combustion system and method in which a recycle heat exchanger is located adjacent the furnace section of the recycle heat exchanger. Heat exchange surfaces are provided in one compartment of the heat exchanger for removing heat from the solids, and a bypass compartment is provided through which the solids directly pass to the furnace during start-up and low load conditions. A separate cooling compartment for the separated solids is disposed in the recycle heat exchange and valves are provided to selectively control the flow of solids between compartments.

29 Claims, 2 Drawing Sheets

FLUIDIZED BED COMBUSTION SYSTEM AND METHOD HAVING A MULTICOMPARTMENT EXTERNAL RECYCLE HEAT EXCHANGER

BACKGROUND OF THE INVENTION

This invention relates to a fluidized bed combustion system and a method of operating same and, more particularly, to such a system and method in which a multicompartment recycle heat exchanger is provided adjacent the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases and the solids entrained thereby from the fluidized bed. The solids are separated from the flue gases in the separator and the flue gases are passed to a heat recovery area while the solids are recycled back to the furnace through a seal pot or seal valve. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a substantially isothermal temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is no needed.

However, in a steam generator using a circulating fluidized bed with sulfur capture and a cycle that requires reheat duty as well as superheater duty, the existing heat available in the flue gases at the furnace section outlet is not sufficient. At the same time, heat in the furnace cyclone recycle loop is in excess of the steam generator duty requirements. For such a cycle, the design must be such that the heat in the recycled solids must be utilized before the solids are reintroduced to the furnace section.

To provide this extra heat capacity, a recycle heat exchanger is sometimes located between the separator solids outlet and the fluidized bed of the furnace section. The recycle heat exchanger includes superheater heat exchange surface and receives the separated solids from the separator and functions to transfer heat from the solids to the superheater surfaces at relatively high heat transfer rates before the solids are reintroduced to the furnace section. The heat from the superheater surfaces is then transferred to cooling circuits in the heat recovery area to supply the necessary reheat duty.

The simplest technique for controlling the amount of heat transfer in the recycle heat exchanger is to vary the level of solids therein. However, situations exist in which a sufficient degree of freedom in choosing the recycle bed height is not available, such as for example, when a minimum fluidized bed solids depth or pressure is required for reasons unrelated to heat transfer. In this case, the heat transfer may be controlled by utilizing "plug valves" or "L valves" for diverting a portion of the recycled solids so that they do not contact and become cooled by the recycle heat exchanger. The solids from the diverting path and from the beat exchanger path are recombined or each stream is directly routed to the furnace section to complete the recycle path. In this manner, the proper transfer of heat to the heat exchanger surface is achieved for the unit load existing. However, these type arrangements require the use of moving parts within the solids system and/or need external solids flow conduits with associated aeration equipment which adds considerable cost to the system.

In order to reduce these costs, a system has been devised that is disclosed in U.S. application Ser. No. 07/632,634 filed on Dec. 26, 1990 by the assignee of the present invention. According to this system, a recycle heat exchanger is provided for receiving the separated solids and distributing them back to the fluidized bed in the furnace section. The recycle heat exchanger is located externally of the furnace section of the system and includes an inlet chamber for receiving the solids discharged from the separators. Two additional chambers are provided which receive the solids from the inlet chamber. The solids are fluidized in the additional chambers and heat exchange surfaces are provided in one of the additional chambers for extracting heat from the solids. The solids in the additional chamber are permitted to flow into an outlet chamber when the level in the former chamber exceeds a predetermined height set by the height of an overflow weir. The solids entering the outlet chamber are then discharged back to the fluidized bed in the furnace section.

However, there are some disadvantages associated with this type of operation. For example, the space available for heat exchanger surfaces is limited, and pressure fluctuations in the furnace section are transmitted to the external heat exchanger which results in erratic performance. Also, the solids are directed from the heat exchanger through one discharge pipe to one relatively small area of the furnace section which is inconsistent with uniform mixing and distribution of the solids. Also, there is no provision for directly controlling the flow of solids between compartments. Further, this system relies on pressure differential to drive the solids from the heat exchanger to the furnace section which requires power. Still further, there is no provision for controlling the solids inventory, or furnace loading.

SUMMARY OF THE INVENTION

It is an object of the present invention to provide a fluidized bed combustion system and method which utilizes a recycle heat exchanger disposed adjacent the furnace section of the combustion system for removing heat from the separated solids before they are recycled back to the furnace.

It is a further object of the present invention to provide a system and method of the above type in which the heat removed from the separated solids in the recycle heat exchanger is used to provide reheat duty and control the desired furnace temperature.

It is a further object of the present invention to provide a system and method of the above type in which the need for heat exchange surfaces in the heat recovery area of the combustion system is reduced.

It is a further object of the present invention to provide a system and method of the above type in which heat is removed from the separated solids without reducing the temperature of the flue gases.

It is a further object of the present invention to provide a system and method of the above type in which the heat removed from the separated solids in the recycle heat exchanger is transferred to fluid circulating in a heat exchange relation with the combustion system.

It is a still further object of the present invention to provide a system and method of the above type in which the recycle heat exchanger includes a direct bypass for routing the separated solids directly and uniformly to the furnace section without passing over any heat exchange surfaces, during start-up, shut-down, unit trip, and low load conditions.

It is a still further object of the present invention to provide a system and method of the above type in which multiple compartments are provided in the recycle heat exchanger and the flow of separated solids between compartments is selectively controlled to increase the heat exchange efficiency.

It is a still further object of the present invention to provide a system and method of the above type in which the recycle heat exchanger is isolated from pressure fluctuations in the furnace.

It is a still further object of the present invention to provide a system and method of the above type in which the separated solids are driven from the recycle heat exchanger to the furnace by height differentials.

It is a still further object of the present invention to provide a system and method of the above type in which a separate cooling compartment for the separated solids is provided in the external heat exchanger to control the solids inventory or furnace loading.

Toward the fulfillment of these and other objects, the system of the present invention includes a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger. Heat exchange surfaces are provided in one compartment of the heat exchanger for removing heat from the solids, and a bypass compartment is provided through which the solids directly pass to the furnace during start-up and low load conditions. A separate cooling compartment for the separated solids is disposed in the recycle heat exchange and means are provided to selectively control the flow of solids between compartments.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
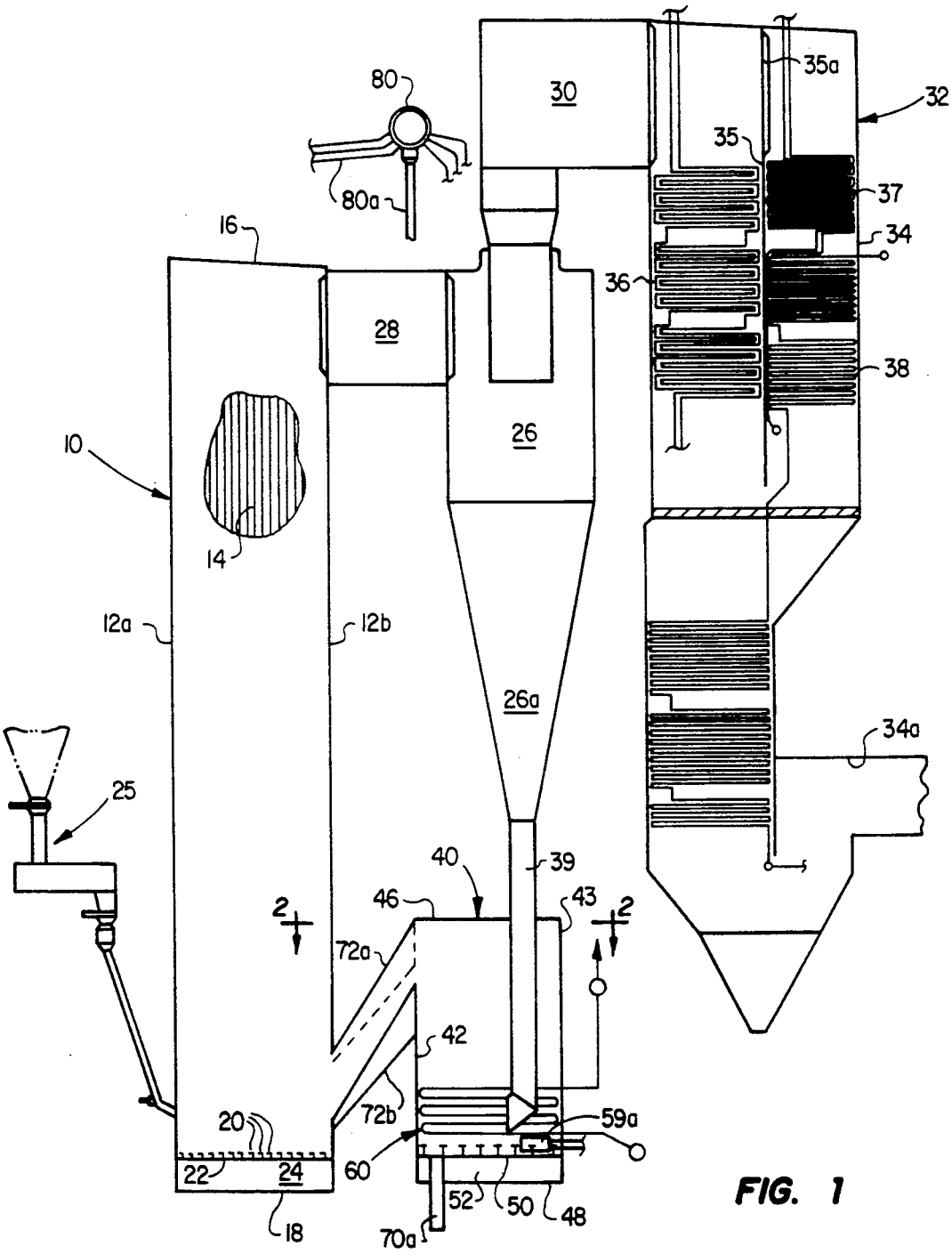
FIG. 1 is a schematic representation depicting the system of the present invention.

The drawings depict the fluidized bed combustion system of the present invention used for the generation of steam and including an upright water-cooled enclosure, referred to in general by the reference numeral 10, having a front wall 12*a*, a rear wall 12*b* and two sidewalls on of which is shown by the reference numeral 14. The upper portion of the enclosure 10 is closed by a roof 16 and the lower portion includes a floor 18.

A plurality of air distributor nozzles 20 are mounted in corresponding openings formed in a plate 22 extending across the lower portion of the enclosure 10. The plate 22 is spaced from the floor 18 to define an air plenum 24 which is adapted to receive air from an external source (not shown) and selectively distribute the air through the plate 22 and to portions of the enclosure 10, as will be described.

A coal feeder system, shown in general by the reference numeral 25, is provided adjacent the front wall 12 for introducing particulate material containing fuel into the enclosure 10. Since the feeder system 25 is conventional it will not be described in any further detail. It is understood that a particulate sorbent material can also be introduced into the enclosure 10 for absorbing the sulfur generated as a result of the combustion of the fuel. This sorbent material may be introduced through the feeder 25 or independently through openings in the walls 12*a*, 12*b*, or 14.

The particulate fuel and sorbent material (hereinafter termed "solids") in the enclosure 10 is fluidized by the air from the plenum 24 as the air passes upwardly through the plate 22. This air promotes the combustion of the fuel in the solids and the resulting mixture of combustion gases and the air (hereinafter termed "flue gases") rises in the enclosure by forced convection and entrains a portion of the solids to form a column of decreasing solids density in the upright enclosure 10 to a given elevation, above which the density remains substantially constant.

A cyclone separator 26 extends adjacent the enclosure 10 and is connected thereto via a duct 28 extending from an outlet provided in the rear wall 12*b* of the enclosure 10 to an inlet provided through the separator wall. The separator 26 includes a hopper portion 26*a* extending downwardly therefrom. Although reference is made to one separator 26, it is understood that one or more additional separators (not shown) may be disposed behind the separator 26. The number and size of separators used is determined by the capacity of the steam generator and economic considerations.

The separator 26 receives the flue gases and the entrained particle material from the enclosure 10 in a manner to be described and operates in a conventional manner to disengage the solids from the flue gases due to the centrifugal forces created in the separator. The separated flue gases, which are substantially free of solids, pass, via a duct 30 located immediately above the separator 26, into a heat recovery section shown in general by the reference numeral 32.

The heat recovery section 32 includes an enclosure 34 divided by a vertical partition 35 into a first passage which houses a reheater 36, and a second passage which houses a primary superheater 37 and an economizer 38, all of which are formed by a plurality of heat exchange tubes extending in the path of the gases from the separator 26 as they pass through the enclosure 34. An opening 35*a* is provided in the upper portion of the partition 35 to permit a portion of the gases to flow into the passage containing the superheater 37 and the economizer 38. After passing across the reheater 36, superheater 37 and the economizer 38 in the two parallel passes, the gases exit the enclosure 34 through an outlet 34*a* formed in the rear wall thereof.

Figure 2:
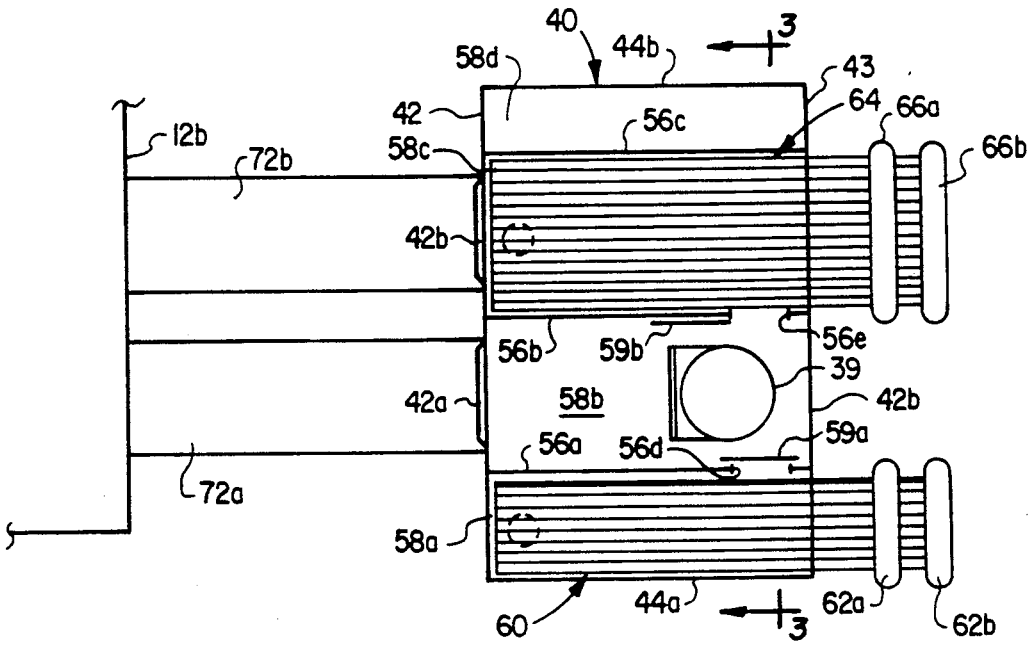
FIG. 2 is a cross-sectional view taken along the line 2—2 of FIG. 1.
Figure 3:
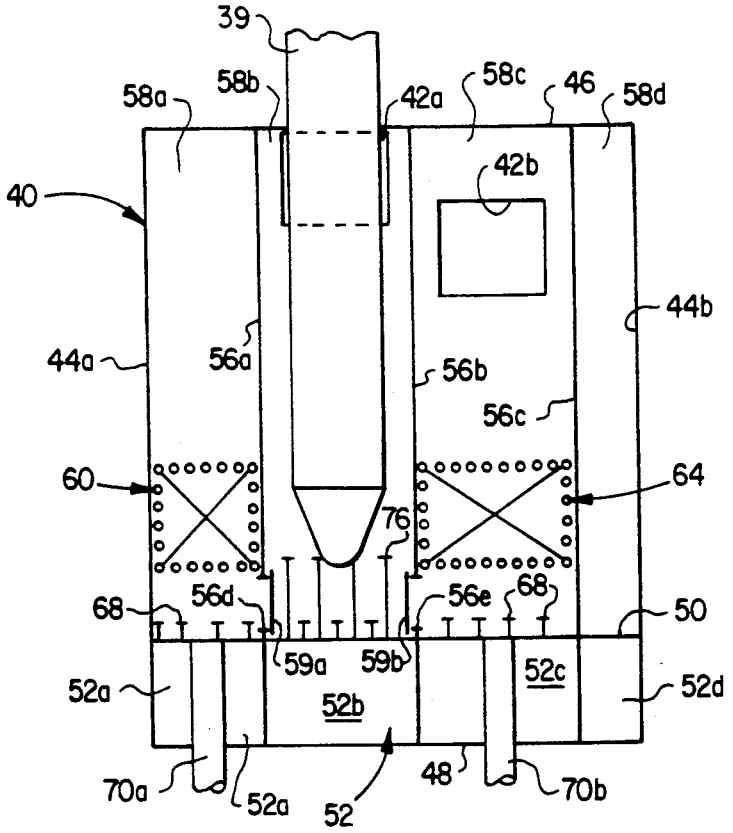
FIG. 3 is a cross-sectional view taken along the line 3—3 of FIG. 2.

The separated solids in the separator 26 pass downwardly, by gravity, into and through the hopper portion 26*a* from which they pass, via a dipleg 39, into a recycle heat exchanger enclosure, shown in general by the reference numeral 40, provided adjacent the enclosure 10 and below the separator 26. As better shown in FIGS. 2 and 3, the enclosure 40 includes a front wall 42 a rear wall 43 and two sidewalls 44*a* and 44*b*. A roof 46 and a floor 48 extend across the upper ends and the lower ends, respectively, of the walls 42, 43, 44*a* and 44*b*. A plate 50 extends across the enclosure 40 in a slightly-spaced relation to the floor 48 to define a plenum 52. Three vertical partitions 56*a*, 56*b* and 56*c* extend in a spaced, parallel relation to, and between, the sidewalls 44*a* and 44*b* to define four compartments 58*a*, 58*b* 58*c* and 58*d*. The partitions 56*a*, 56*b* and 56*c* also extend into the plenum 52 to divide it into three sections 52*a*, 52*b* and 56*c* (FIG. 3). It is understood that dampers, or the like, (not shown) can be provided to selectively distribute air to the individual plenum sections 52*a*, 52*b* and 52*c*.

Two openings 56*d* and 56*e* are provided in the lower portions of the partition 56*a* and 56*b*, respectively, just above the plate 50, and a pair of sliding gate valves 59*a* and 59*b* are mounted relative to the partitions 56*a* and 56*b*, to control the flow of solids through the openings 56*e* and 56*d* as will be discussed.

A bank of heat exchange tubes, shown in general by the reference numeral 60, are provided in the compartment 58*a* with the respective end portions of each tube extending outwardly through appropriate openings in the rear wall 43. The ends of each tube are connected to an inlet header 62*a* and outlet header 62*b*, respectively (FIG. 2). Similarly, a bank of heat exchange tubes 64 are provided in the compartment 58*c* and are connected at their respective ends to an inlet header 66*a* and an outer header 66*b*.

As better shown in FIG. 3, a plurality of air discharge nozzles 68 extend upwardly from the plate 50 in each of the compartments 58*a*, 58*b* and 58*c* and are mounted in corresponding openings formed through the plate for receiving air from the plenum sections 52*a*, 52*b* and 52*c* and introducing the air into the compartments 58*a*, 58*b* and 58*c*, respectively.

A pair of drain pipes 70*a* and 70*b* are provided in the plenum sections 52*a* and 52*c*, respectively, and extend downwardly from the plate 50 and through the floor 48 to discharge solids from the latter compartments.

An opening 42*a* (FIG. 3) is provided through upper portion of the front wall 42 of the enclosure 40 which registers with the compartment 58*b*, and an opening 42*b* is provided through the upper portion of the wall 42 in registery with the compartment 58*c*. The opening 42*a* is located an elevation higher than the opening 42*b* for reasons to be described. Two conduits 72*a* and 72*b* respectively connect the openings 42*a* and 42*b* to corresponding openings formed in the rear wall 12*b* of the enclosure 10 to permit solids from the compartments 58*b* and 58*c* to be transferred to the enclosure 10 as will be described.

Figure 4:
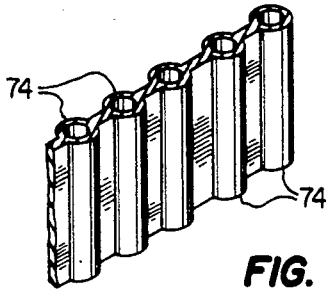
FIG. 4 is a partial, enlarged perspective view of a portion of a wall of the enclosure of the system of FIG. 1.

The front wall 12*a*, the rear wall 12*b*, the sidewalls 14, roof 16, as well as the walls defining the separator 26 and the heat recovery enclosure 34 all are formed of membrane type walls a example of which is depicted in FIG. 4. As shown, each wall is formed by a plurality of finned tubes 74 disposed in a vertically extending, air tight relationship with adjacent finned tubes being connected along their lengths.

A steam drum 80 is located above the enclosure 10 and, although not shown in the drawings, it is understood that a plurality of headers are disposed at the ends of the various walls described above. Also, a plurality of downcomers, pipes, risers, headers etc., some of which are shown by the reference numeral 80*a*, are utilized to establish a steam and water flow circuit including the steam drum 80, the tubes 74 forming the aforementioned water tube walls and the tubes 60 and 64 in the compartments 58*a* and 58*c*. The economizer 38 receives feed water and discharges it to the drum 80 and the water is passed, in a predetermined sequence through this flow circuitry to convert the water to steam and heat the steam by the heat generated by combustion of the particulate fuel material in the enclosure 10.

In operation, the solids are introduced into the enclosure 10 through the feeder system 25. Air from an external source is introduced at a sufficient pressure into the plenum 24 and the air passes through the nozzles 20 and into the enclosure 10 at a sufficient quantity and velocity to fluidize the solids in the latter section.

A lightoff burner (not shown), or the like, is provided to ignite the fuel material in the solids, and thereafter the fuel material is self-combusted by the heat in the furnace section. The flue gases pass upwardly through the enclosure 10 and entrain, or elutriate, a majority of the solids. The quantity of the air introduced, via the air plenum 24, through the nozzles 20 and into the interior of the enclosure 10 is established in accordance with the size of the solids so that a circulating fluidized bed is formed, i.e. the solids are fluidized to an extent that substantial entrainment or elutriation thereof is achieved. Thus the flue gases passing into the upper portion of the enclosure 10 are substantially saturated with the solids and the arrangement is such that the density of the bed is relatively high in the lower portion of the enclosure 10, decreases with height throughout the length of this enclosure 10 and is substantially constant and relatively low in the upper portion of the enclosure.

The saturated flue gases in the upper portion of the enclosure exit into the duct 28 and pass into the cyclone separator 26. In the separator 26, the solids are separated from the flue gases and the former passes from the separator through the dipleg 39 and into the enclosure 40. The clean flue gases from the separator 26 exit, via the duct 30, and pass to the heat recovery section 32 for passage through the enclosure 34 and across the reheater 36, the superheater 37, and the economizer 38, before exiting through the outlet 34*a* to external equipment.

Normally, the sliding gate valve 59*a* is in its closed position and the valve 59*b* is in its open position as shown in FIG. 2 so that the separated solids from the dipleg 39 enter the compartment 58*b* and pass, via the opening 56*e*, into the compartment 58*c*. Air is introduced into the section 52*c* of the plenum 52 below the compartment 58*c* and is discharged through the corresponding nozzles 68 to fluidize the solids in the compartment 58*c*. The solids in the compartment 58*c* pass in a generally upwardly direction across the heat exchange tubes 64, exit via the opening 42*b* into the conduit 72*b*, and pass back into the enclosure 10. Although not normally necessary, the solids can be discharged from the compartment 58*c*, via the drain pipe 70*b*, as needed. During this operation, fluidizing air is not introduced into the air plenum section 52*b* associated with the compartment 58*b* and since the opening 42*b* in the wall 42*a* is at a greater height than the openings 42*c*, very little, if any, flow of solids through the compartment 58*b* occurs.

During initial start up and low load conditions, the sliding gate valve 59*b* is closed and the fluidizing air to the plenum section 52*b* is turned on while the air flow to the section 52*c* is turned off. The solids in the compartment 58*c* thus slump and therefore seal this volume from further flow. The solids from the dipleg 39 pass into the compartment 58*b* and the air passing into the compartment from the plenum section 52*b* and the nozzles 68 forces the material upwardly and outwardly through the opening 42*a* and the conduit 72*a* to the enclosure 10. Since the compartment 58*b* does not contain heat exchanger tubes, it functions as a direct bypass, or a "seal pot", so that start up and low load operation can be achieved without exposing the heat exchanger tubes 64 to the hot recirculating solids.

Although normally all of the separated solids from the separator 26 are recycled, under certain circumstances it may be desirable to extract some solids from the system. In this case the sliding gate valve 59*a* is opened to expose the opening 56*d* in the partition 56*a* and air is introduced into the plenun section 52*a*. This induces solids flow from the compartment 58*b*, through the opening 56*d*, into the compartment 58*a*, and across the heat exchange tubes 60 to cool the solids before they are discharged through the drain pipe 70*a*. During this operation any air flow through the plenum sections 52*b* and 52*c* is terminated, and the sliding gate value 59*b* closed, as needed.

The compartment 58*d* is provided for accommodating any additional heat exchange tubes to remove additional heat from the solids as might be needed. The compartment 58*d* is in fluid communication with the compartment 58*c* through an opening (not shown).

Fluid, such as feedwater, is introduced to and circulated through the flow circuit described above in a predetermined sequence to convert the feedwater to steam and to reheat and superheat the steam. To this end, the heat removed from the solids by the heat exchanger tubes 60 and 64 in the compartments 58*a* and 58*c* can be used to provide reheat or additional superheat.

Another technique of selectively controlling the flow of solids through and between the compartments 58*a*, 58*b* and 58*c* is contemplated. According to this technique, the sliding gate valves 59*a* and 59*b* are eliminated and the nozzles 68 in the compartment 58*b* are replaced by a plurality of nozzles 76 (FIG. 3) which extend above the height of the openings 56*d* and 56*e*. Thus, air introduced into the plenum section 52*b* would be discharged into the compartment 52*b* at a height greater than the height of the openings 56*d* and 56*e*. As a result, the solids in the compartment 56*b* extending below the upper end of the nozzles 76 would not be fluidized but rather would tend to slump in the latter compartment, while the solids extending above the nozzle 76 would be fluidized and thus flow upwardly through the compartment 58*b* and out the opening 42*a* in the wall 42 for passage, via the conduit 72*a*, to the enclosure 10. Thus very little, if any, solids flow from the compartment 58*b* through the openings 56*d* and 56*e* would occur. If air flow into the plenum section 52*b*, and therefore compartment 58*b*, is shut off, and air is passed into the plenum sections 52*a* or 52*c*, the latter air would induce the flow of solids from the compartment 58*b* to the compartments 58*a* or 58*c* as described above.

Thus, use of the nozzles 76 enables the solids flow between the compartments 58*a*, 58*b* and 58*c* to be selectively controlled. It is understood that the nozzles 76 can be used in place of the valves 59*a* and 59*b* or in addition thereto.

Several advantages result in the system of the present invention. For example, heat is removed from the separated solids exiting from the separator 26 before they are reintroduced to the enclosure 10 without reducing the temperature of the flue gases. Also, the separated gases are at a sufficient temperature to provide significant heating of the system fluid while the recycle heat exchanger can function to provide additional heating such as might be needed in a reheat cycle. Also the recycled solids can be passed directly from the dipleg 39 to the enclosure 10 during start-up or low load conditions prior to establishing adequate cooling steam flow to the tube 64 in the compartment 58*c*. Further, selective flow of the solids between the compartments 58*a*, 58*b* and 58*c* in the recycle heat exchanger enclosure 4 is permitted depending on the particular operating conditions.

It is understood that several variations may be made in the foregoing without departing from the scope of the present invention. For example, the heat removed from the solids in the compartment 58*c* can be used for heating the system fluid in the furnace section or the economizer, etc. Also, other types of beds may be utilized in the enclosure 10 such as a circulating transport mode bed with constant density through its entire height or a bubbling bed, etc. Also a series heat recovery arrangement can be provided with superheat, reheat and/or economizer surface, or any combination thereof. Further, the number and/or location of the bypass channels in the recycle heat enclosure 40 can be varied.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system, comprising an enclosure, means defining a furnace section in said enclosure, means for forming a fluidized bed in said furnace section, separating means external of said enclosure for receiving a mixture of flue gases and entrained particulate material from said fluidized bed in said furnace section and separating said entrained particulate material from said flue gases, a heat recovery section external of said enclosure and in connection with said separating means for receiving said separated flue gases, a recycle heat exchanger disposed externally of said enclosure and said furnace section and including means defining a first compartment and a second compartment, means for transferring said separated particulate material from said separating means to said first compartment, means connecting said compartments therebetween for allowing said separated particulate material in said first compartment to flow to said second compartment, means cooperating with said connecting means for controlling the flow of said separated particulate material between said compartments and operable in a first mode for permitting said flow to said second compartment and in a second mode for preventing said flow to said second compartment, and first and second passage means respectively connecting said first and second compartments to said furnace section so that, in said first mode of said controlling means, said separated particulate material flows from said first compartment to said second compartment and through said second passage means to said furnace section and, in said second mode of said controlling means, said separated particulate material flows from said first compartment through said first passage means to said furnace section.

2. The system of claim 1 wherein said controlling means comprises valve means associated with said first and second compartments and moveable between a first position permitting the flow of said separated particulate material between said compartments and a second position blocking said flow.

3. The system of claim 1 wherein said recycle heat exchanger include a third compartment and further comprises means connecting said first compartment to said third compartment for allowing said separated particulate material in said first compartment to flow to said third compartment and means for controlling the flow of said separated particulate material between said first compartment and said third compartment.

4. The system of claim 3 wherein said means for controlling the flow of said separated particulate material between said first compartment and said third compartment comprises valve means associated with said first compartment and said third compartment and moveable between a first position permitting the flow of said separated particulate material from said first compartment to said third compartment and a second position blocking said latter flow.

5. The system of claim 3 further comprising drain means associated with said third compartment for removing said separated particulate material therefrom.

6. The system of claim 3 further comprising heat exchange means disposed in said third compartment for removing heat from said separated particulate material therein.

7. The system of claim 1 or 3 further comprising means for selectively introducing air to each of said compartments to fluidize said separated particulate material therein and control said flow of said separated particulate material.

8. The system of claim 3 wherein said first compartment extends between said second compartment and said third compartment.

9. The system of claim 1 or 3 wherein said recycle heat exchanger further includes partitions for defining said compartments.

10. The system of claim 1 or 3 wherein said recycle heat exchanger is comprised of walls, at least a portion of said walls being formed by tubes, and further comprises fluid flow circuit means for passing fluid through said tubes to transfer heat generated in said furnace section to said fluid.

11. The system of claim 10 wherein said flow circuit means further comprises means for passing said fluid through said second compartment of said recycle heat exchanger in heat exchange relation to said separated particulate material in said second compartment to transfer heat from said separated particulate material to said fluid to control the temperature of said separated particulate material passed from said second compartment section to said furnace section.

12. The system of claim 3 wherein said enclosure is comprised of walls, at least a portion of said walls being formed by tubes, and further comprising fluid flow circuit means for passing fluid through said tubes to transfer heat generated in said furnace section to said fluid, said flow circuit means comprising means for passing said fluid through said third compartment of said recycle heat exchanger in heat exchange relation to said separated particulate material in said third compartment to transfer heat from said separated particulate material to said fluid to cool said separated particulate material passed to said third compartment.

13. The system of claim 1 wherein said recycle heat exchanger is located between said separating means and said enclosure.

14. The system of claim 9 wherein said connecting means comprises respective openings formed respectively in the lower portion of said partitions and said controlling means comprises means for introducing air into said first compartment at a level above that of said openings to cause said separated particulate material in said first compartment to flow directly, via said first passage means, to said furnace section.

15. The system of claim 14 further comprising means for selectively introducing air to said second compartment to cause said separated particulate material to flow from said first compartment to said second compartment.

16. A method for operating a fluidized bed combustion system comprising the steps of providing a fluidized bed combustion system having an enclosure in fluid communication with a heat recovery area and at least first and second compartments, forming in said enclosure a combustible fluidized bed of particulate material, combusting said fluidized bed to produce heat and flue gases, said flue gases entraining a portion of said particulate material, separating said entrained particulate material from said flue gases, passing said separated flue gases to said heat recovery area, passing said separated particulate material to said first compartment, controlling the passage of said separated particulate material out of said first compartment by controlling valve means between first and second positions, such that, in said first position said separated particulate material flows to said fluidized bed in said enclosure directly and in said second position said separated particulate material flows to said second compartment and from said second compartment to said fluidized bed in said enclosure.

17. The method of claim 16 steps of providing said fluidized bed combustion system with a third compartment and controlling the passage of said separated particulate material out of said first compartment to said third compartment, and removing said separated particulate material from said third compartment.

18. The method of claim 17 further comprising the step of removing heat from said separated particulate material in said third compartment.

19. The method of claim 16 or 17 further comprising the step of selectively introducing air to each of said compartments to fluidize said separated particulate material therein and permit said flow of said separated particulate material.

20. The method of claim 17 further comprising the step of passing fluid through water wall tubes forming walls of said enclosure to transfer heat generated by said combustion in said furnace section to said fluid.

21. The method of claim 20 further comprising the step of removing heat from said separated particulate material by passing said fluid through heat exchange means in at least one of said second and third compartments in heat exchange relation to said separated particulate material in said compartments to transfer heat from said separated particulate material to said fluid.

22. The method of claim 21 wherein said step of removing heat is controlled to regulate the temperature of said separated particulate material passed from said second compartment to said fluidized bed in said enclosure or removed from said third compartment.

23. The system of claim 1 wherein said controlling means comprises fluidizing means associated with said first and second compartments for fluidizing one of said compartments independently of said other compartment.

24. The system of claim 23 wherein said recycle heat exchanger includes a third compartment, and further comprises fluidizing means associated with said third compartment for controlling the flow of said separated particulate material between said first and said third compartments by fluidizing said third compartment independently of said first compartment.

25. A method for operating a fluidized bed combustion system comprising the steps of providing a fluidized bed combustion system having an enclosure in fluid communication with a heat recovery area and at least first and second compartments, forming in said enclosure a combustible fluidized bed of particulate material, combusting said fluidized bed to produce heat and flue gases, said flue gases entraining a portion of said particulate material, separating said entrained particulate material from said flue gases, passing said separated flue gases to said heat recovery area, passing said separated particulate material to said first compartment located externally of said enclosure, and selectively controlling the flow of said separated particulate material from said first compartment to either said fluidized bed in said enclosure directly, or via a passage to said second compartment located externally of said enclosure, by introducing air into said first compartment at a level above that of said passage to cause said separated particulate material in said first compartment to flow directly to said furnace section or by fluidizing said second compartment to cause said separated particulate material in said first compartment to flow to said second compartment via said passage and then to said furnace section.

26. The system of claim 3 wherein said recycle heat exchanger further includes partitions for defining said compartments, said connecting means comprises respective openings formed respectively in the lower portion of said partitions, said controlling means comprises means for introducing air into said first compartment at a level above that of said openings to cause said separated particulate material in said first compartment to flow directly, via said first passage means, to said furnace section, and further comprising means for selectively introducing air to said second and third compartments to cause said separated particulate material to flow from said first compartment to at least one of said second or third compartments.

27. The method of claim 16 further comprising the step of passing fluid through water wall tubes forming walls of said enclosure to transfer heat generated by said combustion in said furnace section to said fluid.

28. The method of claim 27 further comprising the step of removing heat from said separated particulate material by passing said fluid through heat exchange means in said second compartment in heat exchange relation to said separated particulate material in said second compartment to transfer heat from said separated particulate material to said fluid.

29. The method of claim 28 wherein said step of removing heat is controlled to regulate the temperature of said separated particulate material passed from said second compartment to said fluidized bed in said enclosure.

* * * * *

UNITED STATES PATENT AND TRADEMARK OFFICE

CERTIFICATE OF CORRECTION

PATENT NO. : 5,133,943

DATED : July 28, 1992

INVENTOR(S) : Iqbal F. Abdulally

It is certified that error appears in the above-identified patent and that said Letters Patent is hereby corrected as shown below:

Column 2, line 1, change "no" to --not--.

Column 2, line 35, change "beat" to --heat--.

Column 4, line 39, change "on" to --one--.

Column 6, line 33, change "a" to --an--.

Column 7, line 67, change "value" to --valve--.

Column 8, line 57, change "4" to --40--.

In the Claims:

Claim 17, line 1(column 11, line 16), after "16" add --further comprising the--.

Signed and Sealed this

Second Day of November, 1993

*Attest:*

*Attesting Officer*

BRUCE LEHMAN

*Commissioner of Patents and Trademarks*